US009096998B2

(12) United States Patent
Harper et al.

(10) Patent No.: US 9,096,998 B2
(45) Date of Patent: Aug. 4, 2015

(54) CEILING SYSTEM WITH CEILING ELEMENT MOUNTING BRACKETS

(71) Applicant: ARMSTRONG WORLD INDUSTRIES, INC., Lancaster, PA (US)

(72) Inventors: Nicholas Harper, Stafford (GB); Torquil Goodwin, Stafford (GB); Matthew Woollam, Stafford (GB)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 14/311,725

(22) Filed: Jun. 23, 2014

(65) Prior Publication Data

US 2015/0059279 A1 Mar. 5, 2015

(30) Foreign Application Priority Data

Aug. 28, 2013 (GB) ..... 1315277.2

(51) Int. Cl.

*E04B 2/00* (2006.01)
*E04B 9/06* (2006.01)
*E04B 9/24* (2006.01)
(Continued)

(52) U.S. Cl.

CPC . *E04B 9/06* (2013.01); *E04B 9/001* (2013.01); *E04B 9/12* (2013.01); *E04B 9/18* (2013.01); *E04B 9/245* (2013.01); *E04B 9/247* (2013.01); *E04B 9/36* (2013.01)

(58) Field of Classification Search

CPC ..... E04B 9/06; E04B 9/245; E04B 9/247; E04B 9/36; E04B 9/001; E04B 9/12; E04B 9/18

USPC ..... 52/506.01, 506.05, 506.06, 506.07, 52/506.08, 506.09, 764, 769, 489.1, 52/772–773; 248/317 X, 58 X, 61–63

See application file for complete search history.

(56) References Cited

U.S. PATENT DOCUMENTS 2,841,255 A * 7/1958 Kemp ..... 52/395
2,877,878 A * 3/1959 Jantsch ..... 52/506.09
(Continued)

FOREIGN PATENT DOCUMENTS

FR 2590304 B1 5/1987
JP 06-307000 11/1994
(Continued)

OTHER PUBLICATIONS

Extended EP Search Report, dated Jan. 27, 2015, for corresponding EP Application No. 14180137.3. EP.

*Primary Examiner* — Brian Glessner
*Assistant Examiner* — Beth Stephan
(74) *Attorney, Agent, or Firm* — Amy M. Fernandez

(57) ABSTRACT

A ceiling system in one embodiment includes a longitudinally-extending support member mountable from a ceiling and a clamping bracket attachable to the support member for supporting a ceiling element. The clamping bracket includes a cavity that receives the support member at least partially therein. A resiliently deformable elastic member has a movable bearing surface positioned in the cavity of the clamping bracket. The elastic member is movable from an undeflected inactive position to a deflected active position in response to inserting the support member into the cavity of the clamping bracket. The elastic member applies a force on the support member to help retain the clamping bracket on the support member.

18 Claims, 10 Drawing Sheets

(51) Int. Cl.

| | |
|---|---|
| ***E04B 9/00*** | (2006.01) |
| ***E04B 9/12*** | (2006.01) |
| ***E04B 9/18*** | (2006.01) |
| *E04B 9/36* | (2006.01) |

(56) References Cited

U.S. PATENT DOCUMENTS

| | | | | | |
|---|---|---|---|---|---|
| 3,139,162 | A | * | 6/1964 | Spangenberg | 52/506.08 |
| 3,390,856 | A | * | 7/1968 | Van Buren, Jr. | 248/317 |
| 3,612,461 | A | * | 10/1971 | Brown | 248/317 |
| 3,708,941 | A | * | 1/1973 | Cuckson | 52/506.08 |
| 3,911,638 | A | * | 10/1975 | Englund et al. | 52/506.08 |
| 3,950,900 | A | * | 4/1976 | Simpson | 52/22 |
| 3,969,865 | A | * | 7/1976 | Andersen | 52/506.07 |
| 4,041,668 | A | * | 8/1977 | Jahn et al. | 52/506.09 |
| 4,169,340 | A | * | 10/1979 | Watson | 52/774 |
| 4,283,891 | A | * | 8/1981 | Moeller | 52/144 |
| 4,545,166 | A | * | 10/1985 | Kielmeyer | 52/506.06 |
| 4,580,387 | A | * | 4/1986 | Rogers | 52/665 |
| 4,610,562 | A | * | 9/1986 | Dunn | 403/233 |
| 4,735,030 | A | * | 4/1988 | Judkins | 52/506.09 |
| 4,827,687 | A | * | 5/1989 | Frawley | 52/506.06 |
| 4,858,408 | A | * | 8/1989 | Dunn | 52/506.07 |
| 4,873,809 | A | * | 10/1989 | Paul | 52/506.07 |
| 5,077,951 | A | * | 1/1992 | Baker | 52/506.07 |
| 5,535,566 | A | * | 7/1996 | Wilson et al. | 52/506.07 |
| 5,619,833 | A | * | 4/1997 | Neff | 52/506.07 |
| 6,892,500 | B2 | * | 5/2005 | Zaborowski | 52/506.06 |
| 7,062,886 | B2 | * | 6/2006 | Auriemma | 52/506.07 |
| 7,647,739 | B2 | * | 1/2010 | Boyd | 52/506.05 |
| 2008/0086962 | A1 | * | 4/2008 | Jahn et al. | 52/220.6 |

FOREIGN PATENT DOCUMENTS

| | | | |
|---|---|---|---|
| JP | H0827945 | A | 1/1996 |
| JP | 09-184234 | A | 7/1997 |

* cited by examiner

CEILING SYSTEM WITH CEILING ELEMENT MOUNTING BRACKETS

CROSS-REFERENCE TO RELATED APPLICATIONS

The present applications claims the benefit of priority to GB Patent Application No. 1315277.2 filed Aug. 28, 2013, which is incorporated herein by reference in its entirety.

FIELD OF THE DISCLOSURE

The present invention relates to ceiling systems, and more particularly to ceiling systems including mounting brackets for ceiling elements.

BACKGROUND

Ceiling-mounted suspended baffle and canopy systems are sometimes used in commercial or institutional buildings for various architectural, aesthetic, and acoustical reasons. These ceiling systems generally include a plurality of horizontal supports which are suspended or hung from a ceiling or other overhead structure. Individual decorative ceiling elements may be mounted to the supports which collectively form the ceiling system. Accordingly, variations in the appearance of the ceiling elements include enumerable types of materials, sizes, shapes (e.g. straight, curved, tubular, etc.), surface textures, and colors.

The individual ceiling elements are generally mounted to the suspended horizontal supports with clips or brackets sometimes requiring the use of fasteners and tools. This adds to the complexity and cost of the ceiling system from an initial installation labor and material cost standpoint. In addition, periodic removal and replacement of individual ceiling elements to gain access to mechanical, electrical, or plumbing systems above the elements may also be cumbersome and expensive. It is also generally desirable that the ceiling elements be securely mounted via the clips or brackets in a stable manner to minimize movement of the elements due to drafts created within a building space from sources such as the HVAC system or open doors/windows.

An improved ceiling system with mounting brackets is desired.

SUMMARY

The present invention provides a ceiling system in which individual ceiling elements may be detachably mounted to support members in a secure and stable manner. In one embodiment, without limitation, a specially configured clamping bracket is disclosed which includes a rigid body and an elastic member configured and arranged for rapid and releasable mounting of ceiling elements to a ceiling system without the use of tools or fasteners.

According to an exemplary embodiment, a ceiling system includes a longitudinally-extending support member mountable from a ceiling and a clamping bracket attachable to the support member. The clamping bracket includes a first vertical section and a second opposing vertical section; the first and second vertical sections being spaced apart to define a cavity configured to receive the support member at least partially therein. A resiliently deformable elastic member is connected to the clamping bracket and defines a movable bearing surface positioned in the cavity of the clamping bracket. The elastic member is movable from an undeflected inactive position to a deflected active position in response to inserting the support member into the cavity of the clamping bracket. The bearing surface of the elastic member engages and compresses the support member against the clamping bracket when the elastic member is in the deflected active position for securing the clamping bracket to the support member.

According to another exemplary embodiment, a clamping bracket attachable to a support member for supporting a ceiling element of a ceiling system is provided. The clamping bracket includes a body configured for attachment to the support member, the body including a first vertical section and a second opposing vertical section, the first and second vertical sections being spaced apart to define a cavity configured to receive the support member at least partially therein; and a resiliently deformable elastic member connected to the first vertical section of the body, the elastic member having a movable bearing surface positioned in the cavity of the clamping bracket, the elastic member being movable from an undeflected inactive position to a deflected active position in response to inserting the support member into the cavity. The bearing surface of the elastic member engages the support member when the support member is positioned in the cavity and the elastic member is in the deflected active position. In one embodiment, the elastic member compresses the support member against the second vertical section of the clamping bracket when the elastic member is in the deflected active position.

A method for mounting a ceiling element to a support member of a ceiling system is provided. The method includes: providing a support member mountable from a ceiling; vertically aligning an open cavity of a clamping bracket over the support member; lowering the clamping bracket onto the support member; inserting the support member into the cavity; laterally displacing a resiliently deformable elastic member positioned in the cavity with the support member; and applying a lateral force with a bearing surface of the elastic member against the support member for securing the clamping bracket to the support member. In some embodiments, the method further includes the lateral force compressing the support member against a first vertical section of the clamping bracket opposite the elastic member. The method may further include a step of engaging an angled tab on the first vertical section of the clamping bracket with an opening formed in the support member.

BRIEF DESCRIPTION OF THE DRAWINGS

The features of the exemplary embodiments of the present invention will be described with reference to the following drawings, where like elements are labeled similarly, and in which.

Figure 1:
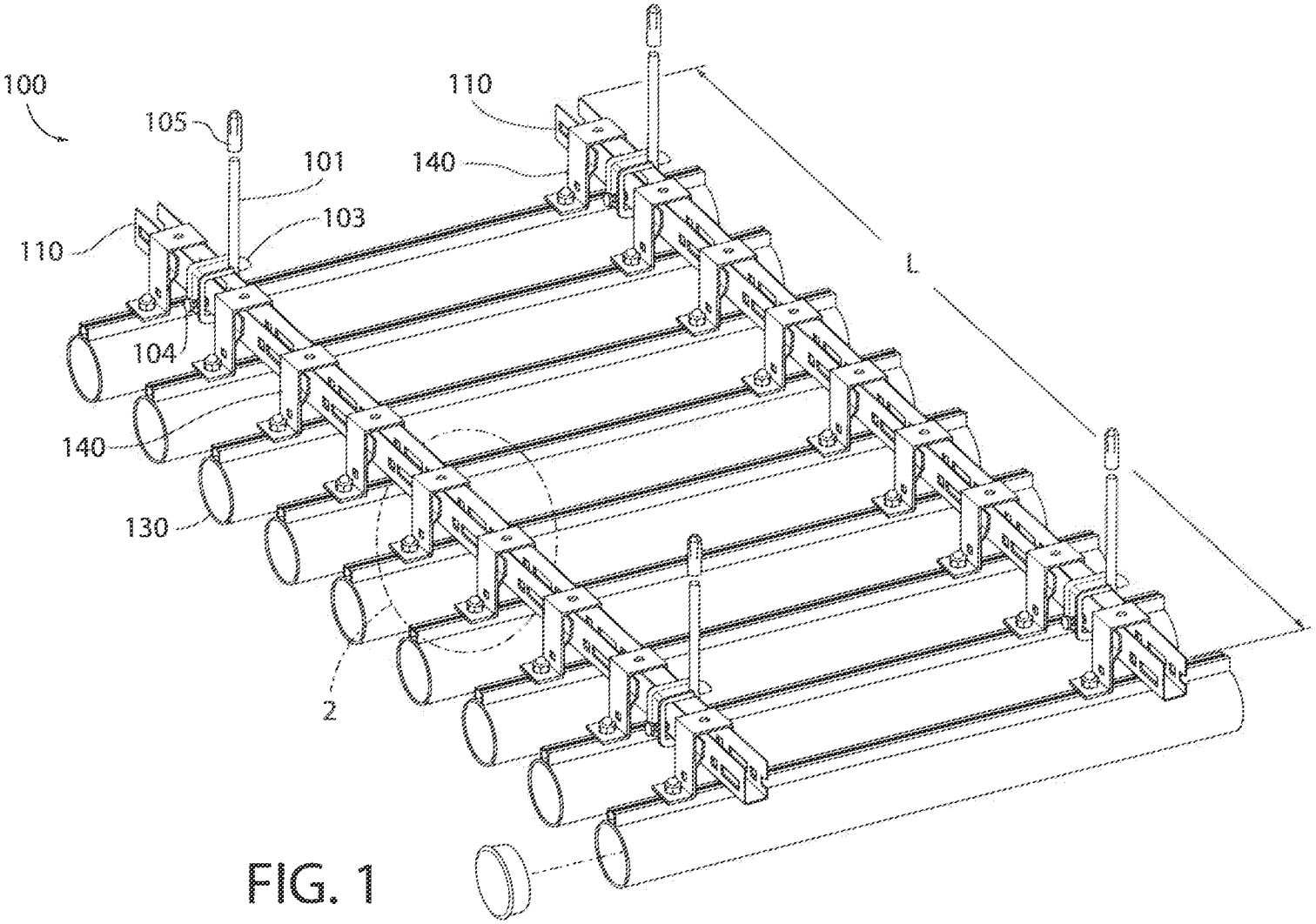
FIG. 1 is a perspective view of a ceiling system including support members, ceiling elements, and ceiling element clamping brackets.
Figure 2:
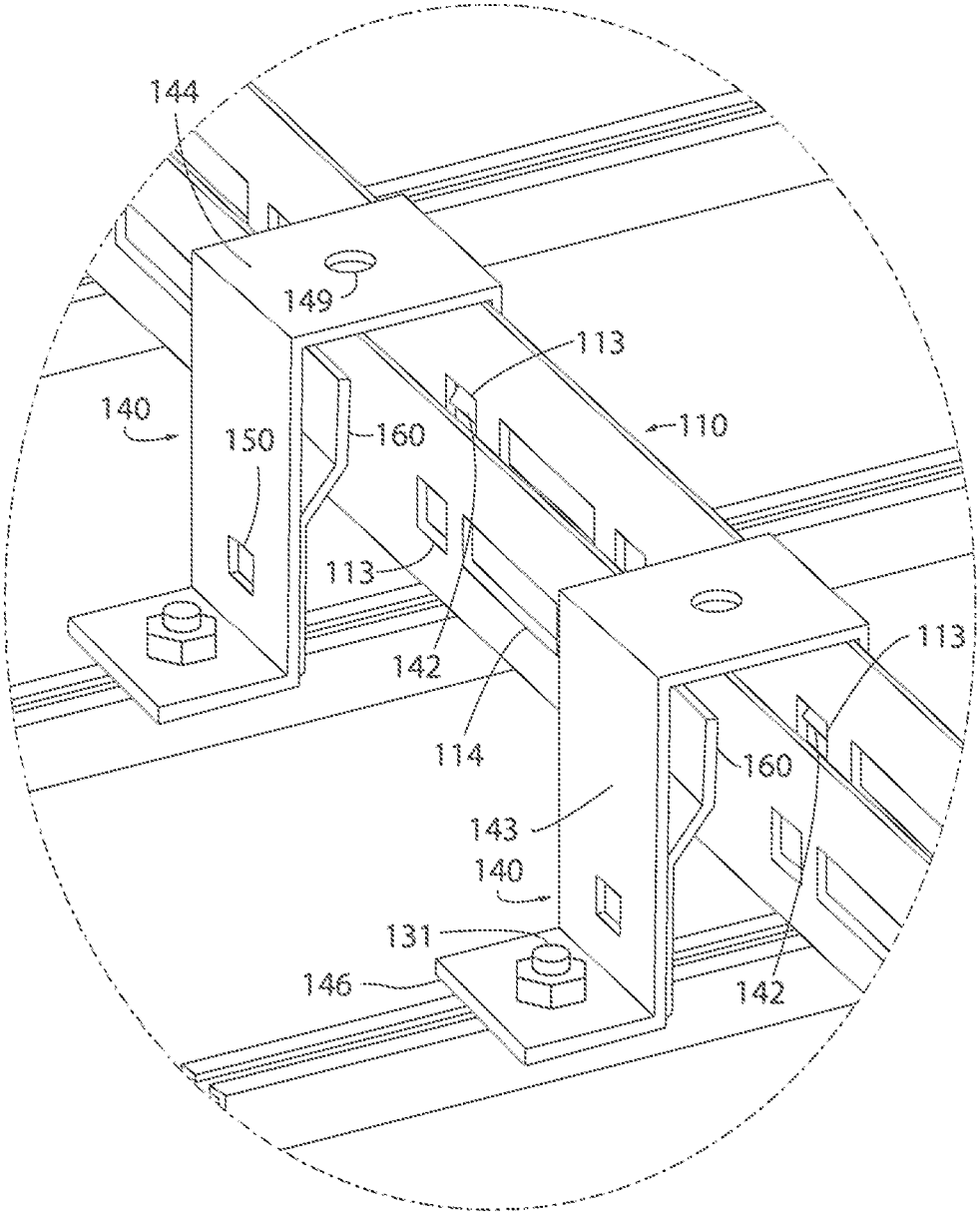
FIG. 2 is an enlarged detail from FIG. 1.
Figure 3:
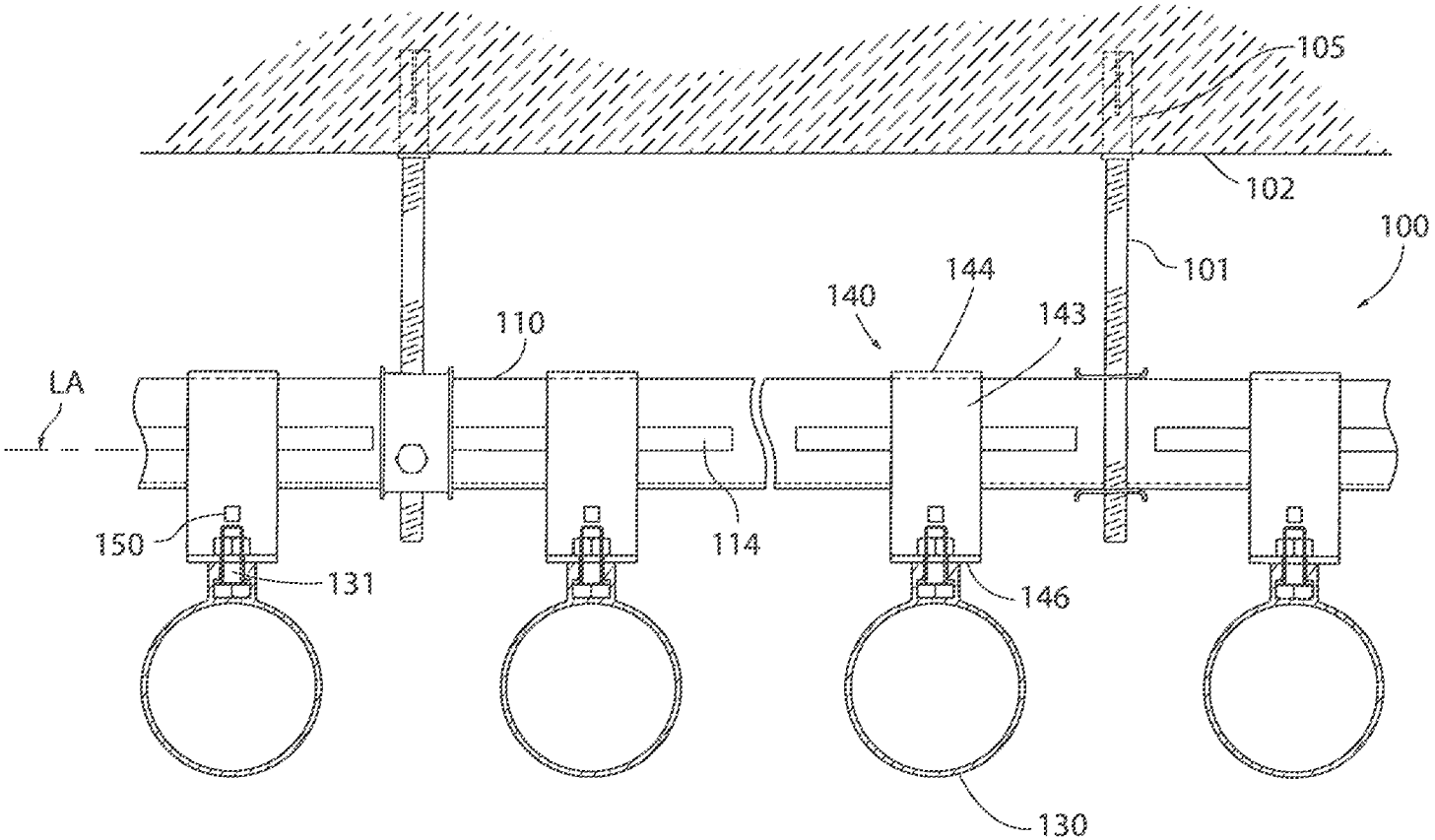
FIG. 3 is a side elevation partial view from FIG. 1.
Figure 4:
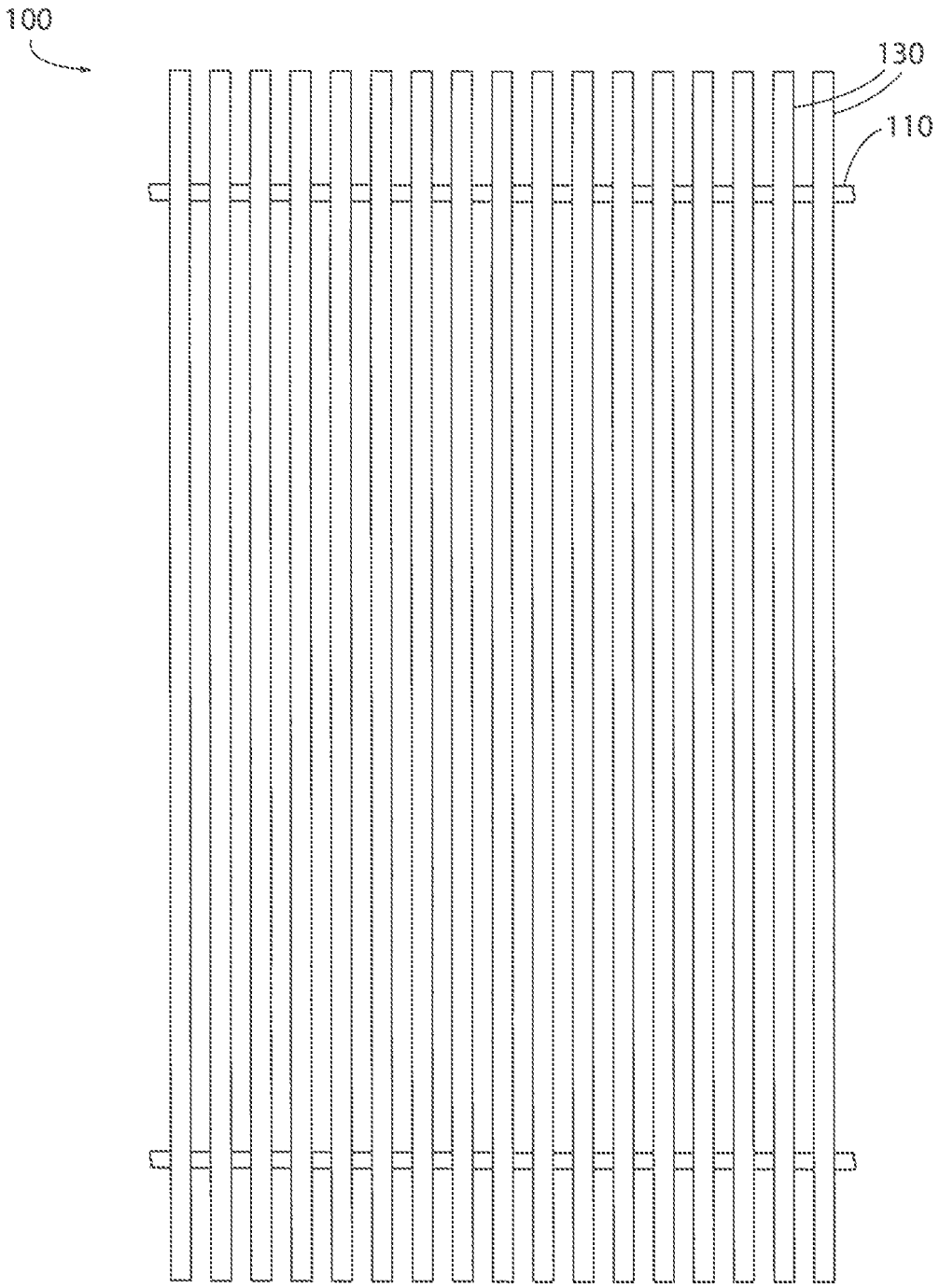
FIG. 4 is top plan view from FIG. 1.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

FIGS. 1-4 depict an exemplary ceiling system 100 according to one embodiment of the present disclosure. The ceiling system 100 includes a plurality of longitudinally-extending elongated support members 110 and a plurality of ceiling elements 130 mounted to the support members with clamping brackets 140. Support members 110 each define a longitudinal axis LA and axial direction extending along the length L of the members. In one embodiment, support members 110 may be horizontally oriented when installed. It will be appreciated, however, that other suitable mounted orientations of support members 110 may be used such as vertical and angled or slanted (i.e. between 0 and 90 degrees to horizontal). Accordingly, although support members 110 may be described in one exemplary orientation herein as horizontal, the invention is not limited to this orientation alone and other orientations may be used.

Support members 110 may be supported from and suspended below a ceiling 102 or other overhead support structure (e.g. beam, deck, etc.) by vertical hangers 101 having any suitable configuration including for example without limitation wires, cables, rods, struts, etc. Hangers 101 may be attached at one end to ceiling 102 or other overhead structure by appropriate mounting components 105 (e.g. expansion or anchor lugs, welding, clamps, brackets, etc.) and at an opposite end to the support members 110. In one embodiment, without limitation, hanger brackets 103 may be used to attach hangers 101 to support members 110. Hanger brackets 103 may be configured to complement the cross-sectional shape of the support members 110. In one embodiment, hanger brackets 103 may be substantially C-shaped or L-shaped. Hanger brackets 103 may include a fastener 104 such as a screw or bolt which may be tightened against the support member 110 to assist with detachably securing the bracket to the support member 110. In some embodiments, hangers 101 may alternatively be directly attached to support members 110 such as by welding or via fasteners such as nuts and threading the end of the hanger for insertion through a hole in the support member. Accordingly, the invention is not limited to the manner of attaching the hangers 101 to the support members 110.

Hangers 101 may be spaced along the length of the support members 110 at appropriate intervals to properly support the weight of the ceiling elements 130. Therefore, any suitable number and spacing of hangers 101 may be used.

Figure 5:
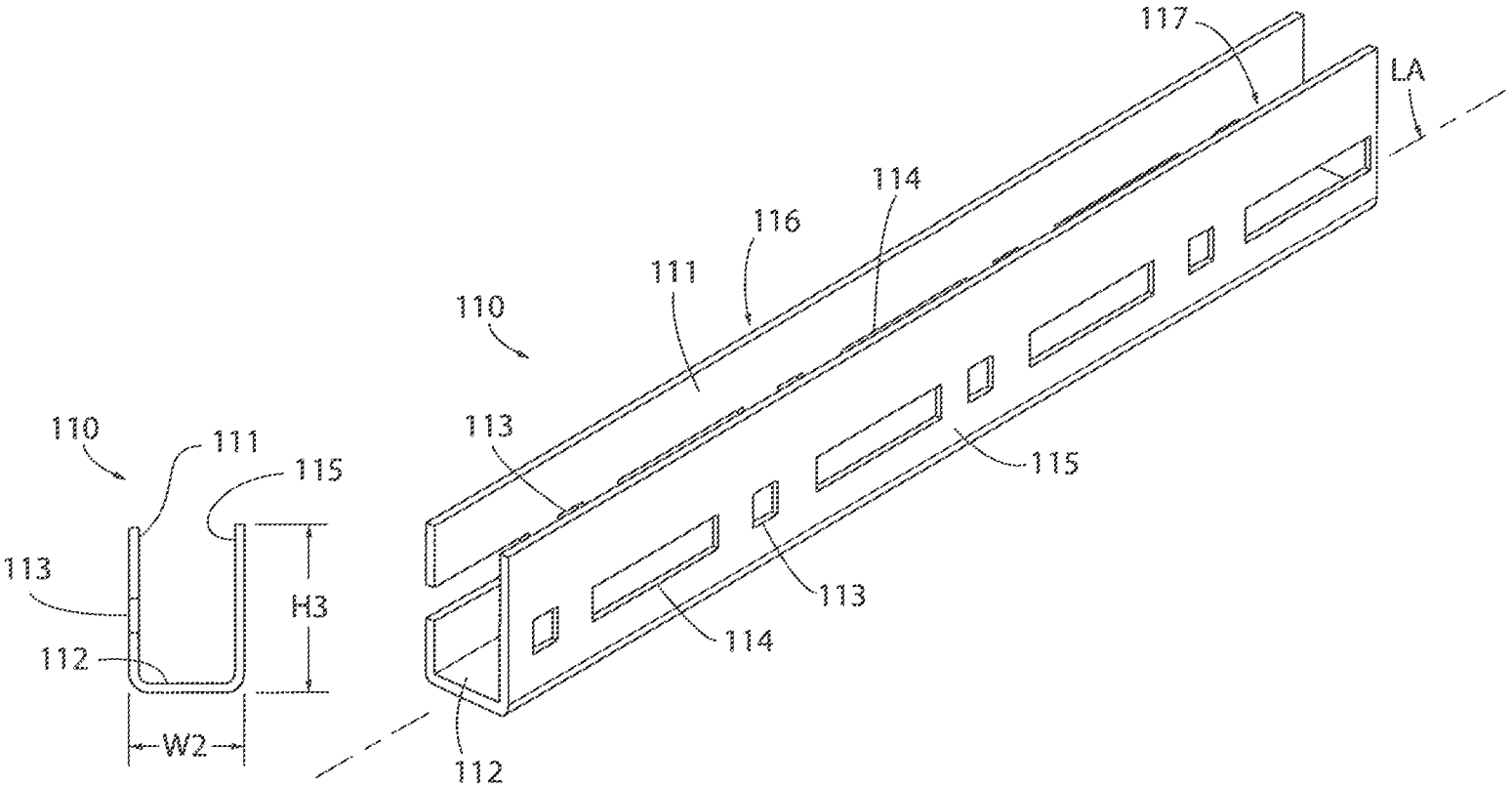
FIG. 5 shows the support member in perspective and end views.

FIG. 5 shows one exemplary embodiment of a support member 110. In this embodiment, the support member 110 may have substantially U-shaped profile (in transverse cross-section) including two horizontally/laterally spaced apart vertical sides 111, 115 connected by a horizontal base 112. Vertical sides 111, 115 define longitudinally-extending top edges 116 and 117, respectively. At least one or both sides 111, 115 may include a plurality of tab openings 113 for connecting clamping brackets 140 to the support members 110. Tab openings 113 may be in the form of generally square cutouts in one non-limiting embodiment which are configured to receive mounting tab 142. The tab openings 113 may be spaced longitudinally apart along one or both sides 111, 115 for intermittently attaching clamping brackets 140 along the length of the support members 110. Tab openings 113 may be uniformly or non-uniformly spaced along the length of the support members 110 depending on the desired spacing of the ceiling elements 130 to be supported from the support members 110. In certain embodiments, axially elongated cutouts 114 may be interspersed between the tab openings 113 and distributed along the length of the support members 110. Cutouts 114 may be used provide access to the rear of clamping bracket 140 through the support member 110.

Support members 110 may be made of metallic or non-metallic material suitable to hold the intended dead or weight load of ceiling elements 130 without undue deflection. In some preferred but non-limiting embodiments, support members 110 may be made of metal including aluminum, titanium, steel, or other.

FIGS. 6-11 illustrate various views of clamping bracket 140. Clamping bracket 140 generally includes a body 141 and a deformable elastic member 160 supported by the body. In one embodiment, body 141 may be more structurally rigid in construction in relation to the more flexible elastic member 160 which is intended to be resiliently deformable having an elastic memory allowing the elastic member to be deformed under load and return to its original configuration. Body 141 may have any suitable shape. In some embodiments, the body 141 may have a generally rectilinear or polygonal configuration (in transverse cross section or end view). In one embodiment, a portion of the body 141 may be generally configured as an inverted U-shaped structural section to complement the U-shaped configuration of the support member 110. Numerous variations in shapes are possible.

Figure 12:
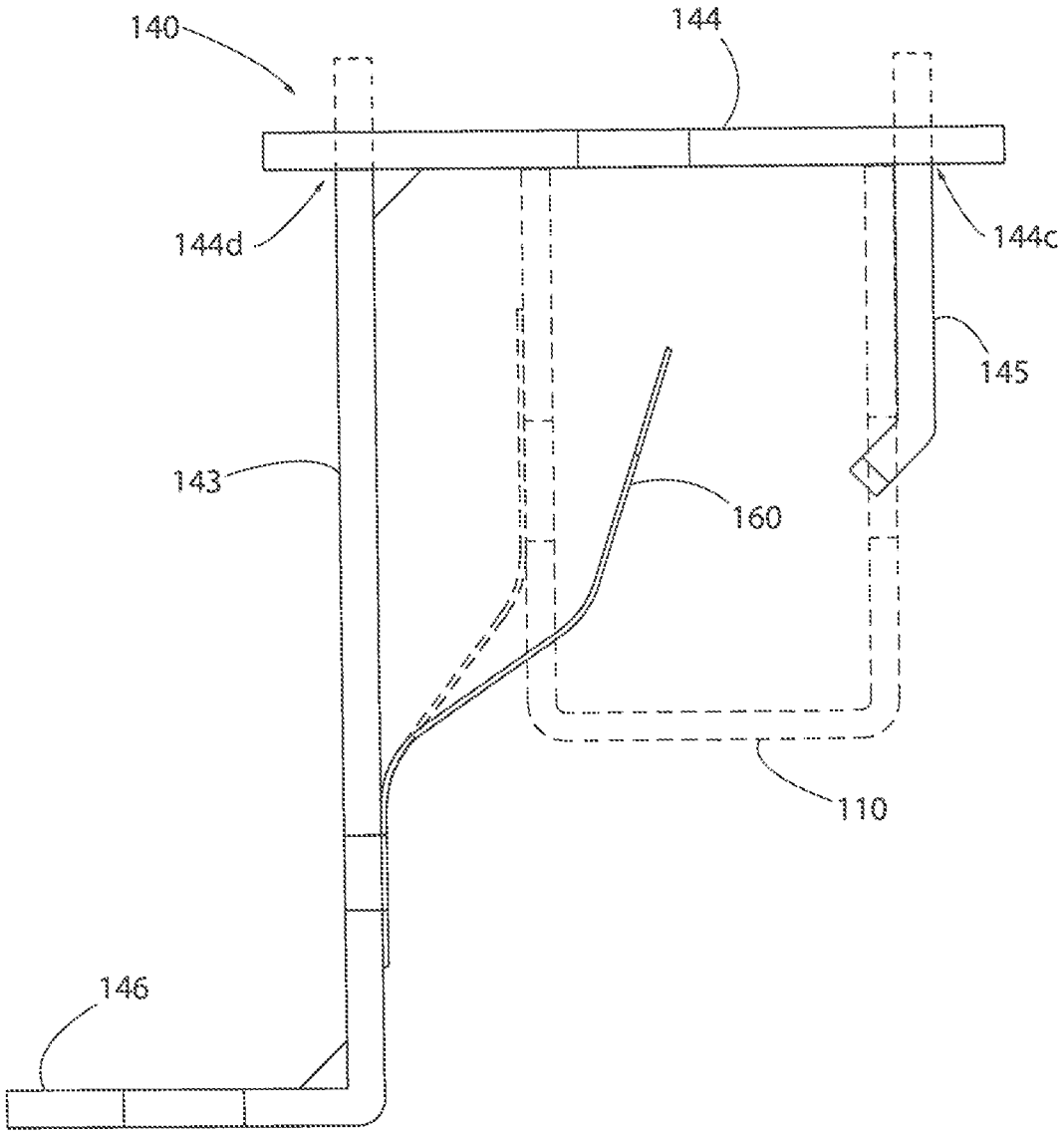
FIG. 12 is a side cross-sectional view of an alternative embodiment of a clamping bracket.

Body 141 of clamping bracket 140 includes laterally spaced apart vertical sections 143, 145, a top section 144 connecting the vertical sections, and a cantilevered extension section 146 projecting laterally outwards from one of the vertical sections. The vertical and top sections define a downwardly open cavity 148 which receives support member 110 at least partially therein for mounting the bracket 140. In one embodiment, vertical sections 143 and 145 may be disposed at opposing lateral ends of top section 144 to define outside corners 144*a*, 144*b*. In other possible embodiments (not shown), one or both of vertical sections 143, 145 may be spaced inwards from the lateral ends of the top section so that a portion of the top section projects laterally outwards beyond the respective vertical section(s). This would produce one or two inside corners 144*c*, 144*d* as shown in FIG. 12 between the vertical sections 143, 145 and top section 144. Either of the foregoing arrangements with inside and/or outside corners may be used without affecting the functioning of the clamping brackets 140 for attachment to support members 110 and may be desirable for different ceiling system installations.

It should be noted that top section 144 need not be flush with and disposed at the very top ends of the vertical sections 143, 145 in some embodiments, but rather may be spaced downwards from the top ends of the vertical sections so that a top portion of the vertical sections projects above the top surface of the top portion (see upper dashed portions of vertical sections 143, 145 shown in FIG. 12).

Vertical section 145 may have a height H2 which is less than the height H1 of vertical section 143. In other possible configurations, vertical section may have a height H2 which is substantially coextensive with height H1 of vertical section 143 or the same height H3 as the support member 110. Vertical sections 143, 145 may be oriented substantially perpendicular to each other to complement the orientation of the vertical sides 111, 115 of support member 110. Vertical sections 143, 145 are separated by an inside lateral width W1 which is at least as large as the outside lateral width W2 of support members 110, and preferably in some embodiments larger than width W2 to accommodate movement of elastic member 160 as further explained herein. This allows the clamping bracket 140 to receive the support members 110 at least partially therein when mounting the brackets, as further described herein.

Top section 144 of clamping bracket 140 in some embodiments may include one or more holes 149 for direct mounting of bracket 140 from the ceiling with a threaded rod and nut in some embodiments and/or mounting other accessories or supports.

With continuing reference to FIGS. 6-11, the cantilevered extension section 146 may be disposed at any suitable height along the height H1 of vertical section 143. In one embodiment, extension section 146 may be disposed at the bottom end of vertical section 143. Extension section 146 is configured for attachment to a ceiling element 130 and provides a means for supporting the ceiling elements from the clamping brackets 140 and in turn from support members 110 hung from ceiling 102. In one embodiment, extension section 146 may include a mounting hole 147 which receives mounting hardware such as a fastener 131 to removably attach the ceiling element 130 to the clamping bracket 140. The fastener 131 may be a screw or bolt in one embodiment which may be coupled to the clamping bracket 140 using a threaded nut (best shown in FIG. 2). Other variations of mounting hardware may be used.

Figure 6:
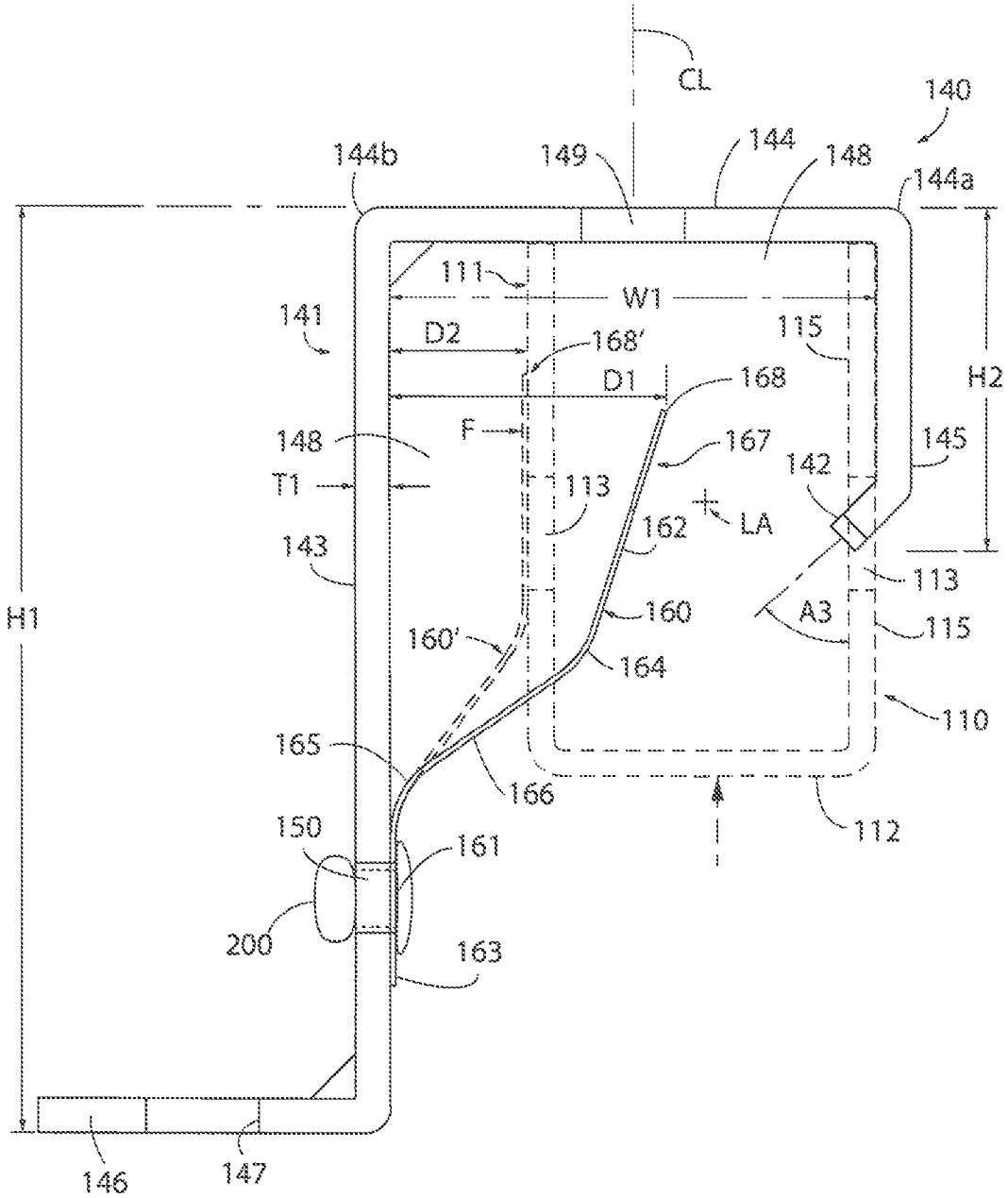
FIG. 6 is a side cross-sectional view of a clamping bracket having an elastic member and a support member in a fully mounted position therein shown in phantom dashed lines.
Figure 8:
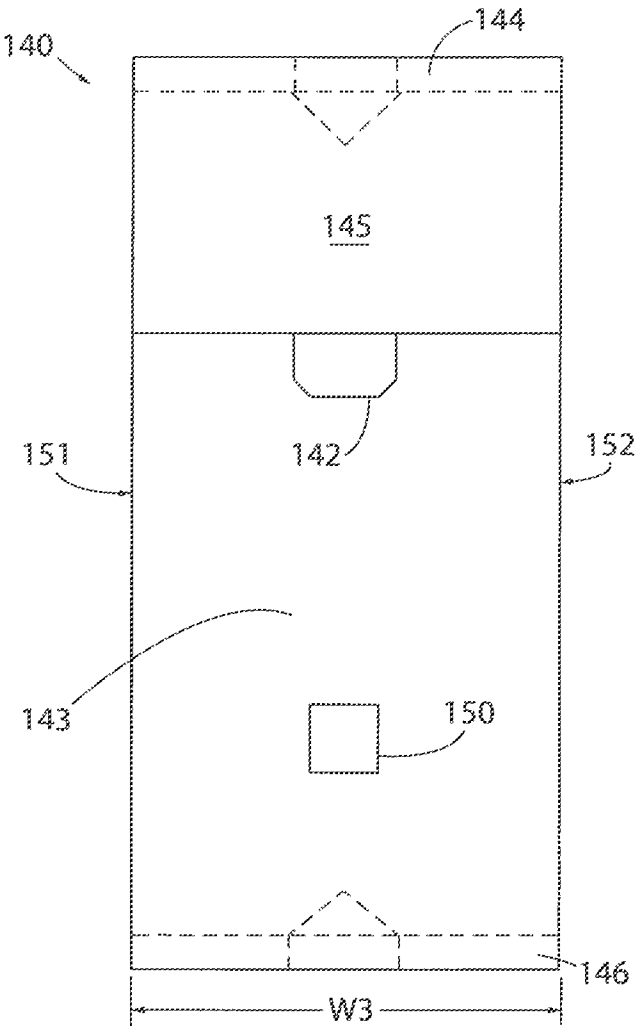
FIG. 8 is an end view of the clamping bracket.
Figure 7:
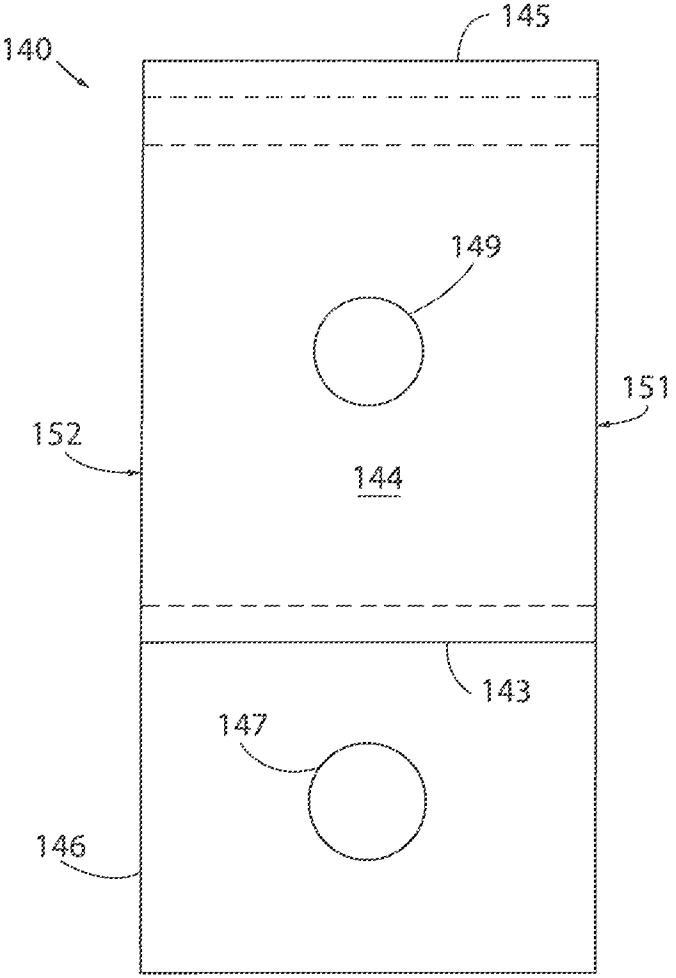
FIG. 7 is top plan view of the clamping bracket.
Figure 9:
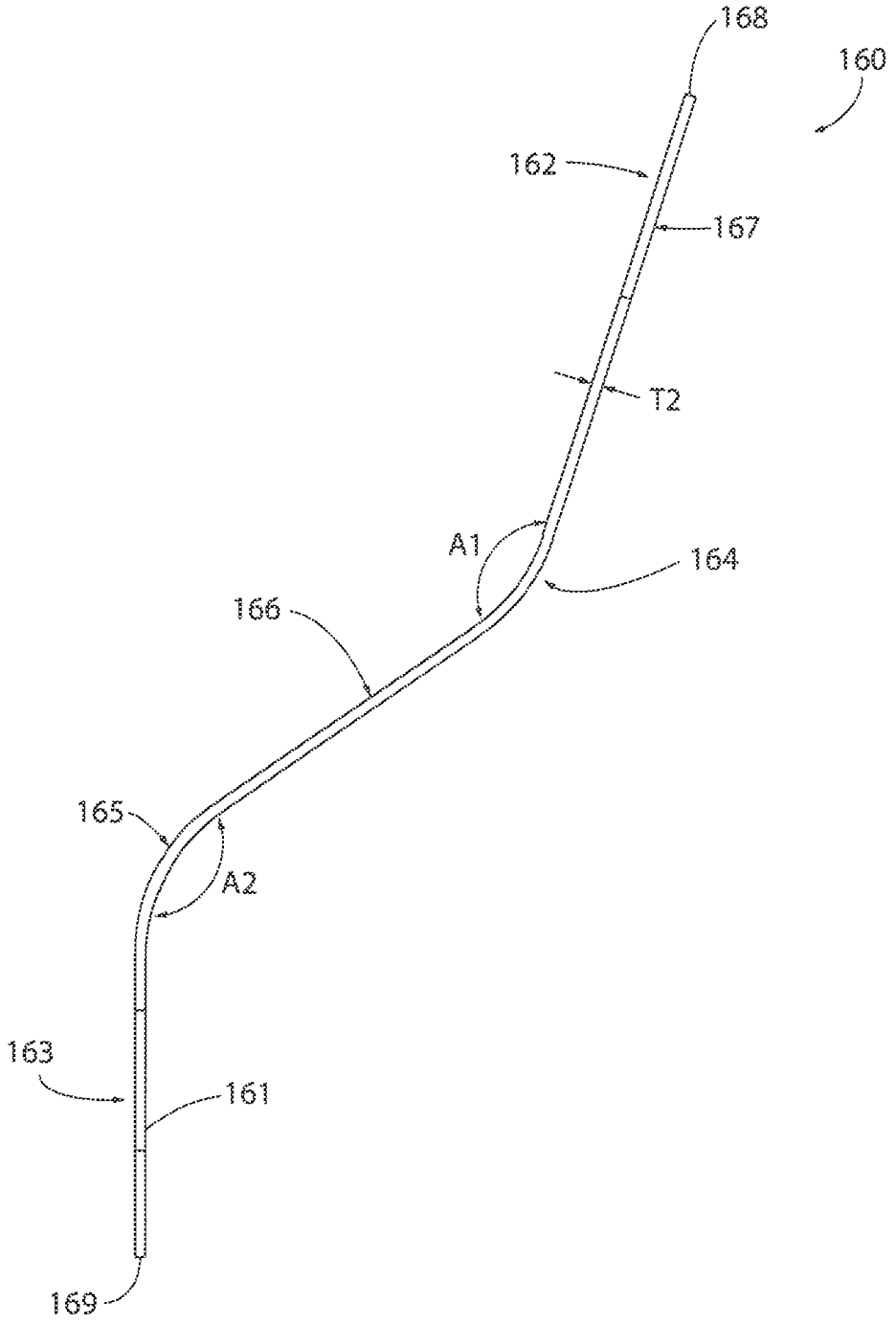
FIG. 9 is a side cross-sectional view of an elastic member of the clamping bracket.
Figure 11:
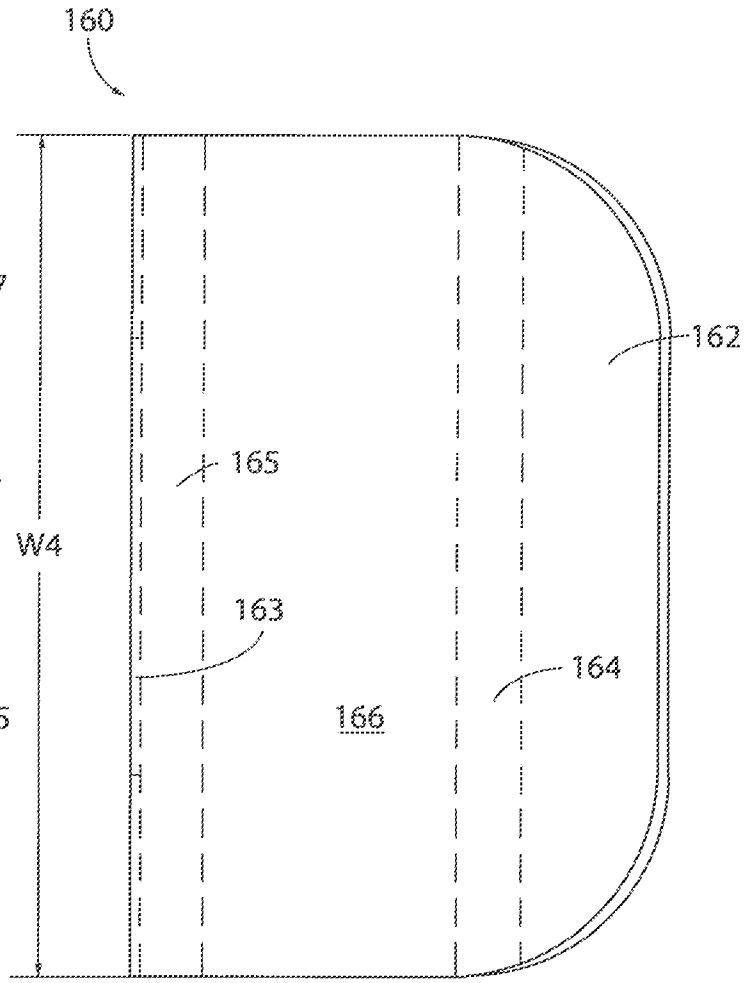
FIG. 11 is a top plan view of the elastic member.
Figure 10:
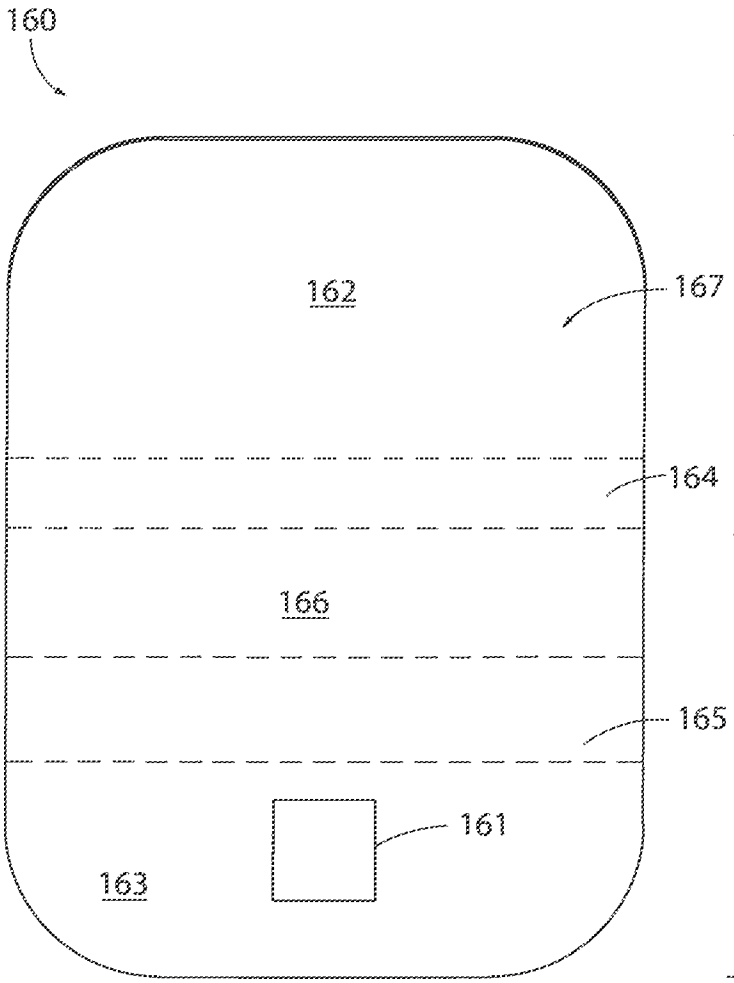
FIG. 10 is an end view of the elastic member.

The shorter vertical section 145 in one embodiment may include mounting tab 142 for engaging a tab opening 113 in support member 110, as noted above. Advantageously, this helps removably secure vertical section 145 to the support member with the use of fasteners. Mounting tab 142 may have a generally rectilinear shape such as square or rectangular in some embodiments with chamfered corners to facilitate insertion of the tab into the tab openings 113. The mounting tab 142 may angled inwards at an angle A3 with respect to vertical section 145 as shown in FIG. 6 to engage tab opening 113 of support member 110 when vertical section 145 is abutted against vertical side 115 of the support member. Tab 142 preferably has a length great enough to at least partially engage tab opening 113 and the tip of the tab may extend into the interior of support member 110 in some arrangements. In one embodiment, mounting tab 142 may be disposed approximately at the midpoint between opposite lateral sides 151, 152 of clamping bracket 140 as shown in FIG. 8; however, other suitable locations may be used. In some embodiments, more than one mounting tab 142 may be used depending on the number and arrangement of tab openings 113 in support member 110.

In one embodiment, the opposite taller vertical section 143 may include a fixing aperture 150 for removably connecting elastic member 160 to the clamping bracket 140. Fixing aperture 150 is axially alignable with a corresponding fixing hole 161 in elastic member 160. A suitably configured fastener 200 may be inserted through the aperture 150 and hole 161 to attach the elastic member 160 to the clamping bracket 140. In one example, without limitation, a pop rivet may be fastened through fixing aperture and hole 150, 161 for mounting elastic member 160. In another example, a threaded fasteners such as a screw or bolt may be inserted through the fixing aperture 150 and fixing hole 161 and secure with a nut. In one configuration, fixing aperture 150 and fixing hole 161 may each have a shape forming coinciding square openings to engage the square shank portion below the head of a fastener such as a carriage bolt. This rectilinear shape of the fixing aperture 150 and fixing hole 161 allows a single fastener to be used and prevents the elastic member 160 from rotating sideways when mounted to the clamping bracket 140 for ensuring an upright position as shown in FIG. 6.

It will be appreciated that numerous other non-rotational ways of removably or permanent affixing elastic member 160 to clamping bracket 140 may be used while preferably maintaining the elastic member in an upright vertical position with respect to the clamping bracket; the foregoing description providing merely a few non-limiting examples of fastening means. Accordingly, in some embodiments, elastic member 160 may be attached to the clamping bracket 140 by welding, soldering, brazing, adhesives, use of two or more threaded fasteners without square shank portions (to eliminate rotation of the elastic member), etc. Accordingly, the invention is expressly not limited to the manner of attaching elastic member 160 to clamping bracket 140.

Clamping brackets 140 have an axial width W3 which is substantially less than the axial length L of support members 110. In one embodiment, elastic members 160 may have an axial width W4 which is approximately the same as or less than the axial width W3 of clamping brackets 140 (measured along longitudinal axis when clamping brackets are mounted on support members 110). In one embodiment, the axial widths W3 and W4 may be approximately the same to maximize the bearing surface area of the elastic member 160 for engaging support member 110 to provide a secure attachment of the clamping bracket.

The elastic members 160 will now be further described.

Referring now to FIGS. 6 and 9-11, elastic member 160 includes an upper securing segment 162 defining a movable free top end 168, a lower mounting segment 163 defining a fixed bottom end 169, and an intermediate segment 166 disposed between segments 162 and 163. A first radiused bend 164 is formed at the intersection between securing segment 162 and intermediate segment 166 which are disposed at a first angle A1 to each other and a second radiused bend 165 is formed at the intersection between mounting segment 163 and intermediate segment 166 which are disposed at a second angle A2 to each other (see, e.g. FIG. 9). Bends 164 and 165 may have a reverse orientation and direction with respect to each other as shown. Angles A1 and A2 may each be greater than 90 degrees and less than 180 degrees, and preferably in some non-limiting embodiments between about 120 degrees and 150 degrees to provide a smoothly curving side profile (see, e.g. FIG. 9). Bends 164 and 165 may be formed in opposite directions as shown to produce a profile of elastic member 160 in which the upper securing segment 162 is laterally offset from the lower mounting segment 163 when the elastic member 160, thereby providing a somewhat zigzag shaped side profile for the elastic member.

Upper securing segment 162 defines a bearing surface 167 which is resiliently movable in response to engaging support member 110 for helping secure the clamping bracket 140 to the support member. Accordingly, in one embodiment, elastic member 160 is laterally movable by a distance between a normal undeflected inactive position (shown in solid lines in FIG. 6) when the clamping bracket 140 is not positioned on support member 110 (i.e. support member 110 not inserted in cavity 148 of clamping bracket 140) and a deflected active position (shown as 160' in dashed lines) when the clamping bracket is positioned on support member (i.e. support member 110 inserted in cavity 148 of clamping bracket 140). Elastic member may therefore be considered to function as a spring capable of producing an elastic spring force, as further described herein.

The clamping bracket 140 and elastic member 160 may be plate-like constructions in some embodiments having various angled sections or portions as shown and described herein. Referring to one embodiment in FIGS. 6 and 9, elastic member 160 has a thickness T2 which is less than thickness T1 of clamping bracket 140 thereby making the elastic member less rigid than the clamping bracket and deformable as described above. In various embodiments, thickness T2 may be 50% or more less than thickness of T1. For example, in one exemplary non-limiting embodiment which may be used, elastic member 160 may have a thickness T2 of about 0.3 mm and clamping bracket 140 may have a thickness T1 of about 2 mm.

In the exemplary embodiment described herein, clamping bracket 140 and elastic member 160 may be separate discrete elements which are connected together. Accordingly, in various embodiments, the clamping bracket and elastic member may be made of the same or different materials. Advantageously, this allows the thickness T2 and/or the material of the elastic member 160 to different than the clamping bracket 140 and selected to provide spring-like characteristics to the elastic member. Conversely, the material and thickness T1 of clamping bracket 140 may be selected to provide greater rigidity and strength or stiffness than elastic member 160 because the clamping bracket supports the weight of the ceiling elements 130.

Clamping bracket 140 and elastic member 160 preferably may be made of metal for strength and durability. In one illustrative, non-limiting example, clamping bracket 140 may be made of galvanized steel and elastic member 160 may be made of stainless steel or spring steel. Other suitable metals such as without limitation aluminum, titanium, and others may be used.

Ceiling elements 130 may be tubular in shape in one non-limiting example as shown in FIGS. 1-4. A plurality of ceiling elements 130 are suspended from one or more support members 110 via clamping brackets 140 in any desired arrangement to form ceiling system 100. It will be appreciated that ceiling elements may have enumerable configurations besides tubular such a baffles, panels, etc. Accordingly, the invention is not limited by the shape or type of ceiling elements which may be supported using clamping brackets 140 and support members 110 described herein.

A method for mounting a ceiling element to a support member of a ceiling system will now be described with primary reference to FIG. 6.

The method includes first providing a clamping bracket 140 with the deformable elastic member 160 in the undeflected normal position as shown by the solid lines in FIG. 6. The elastic member 160 projects into the cavity 148 of the clamping bracket 140 with the top end 168 being spaced at a first horizontal distance D1 from vertical section 143 which will be used as a point of reference. The upper section 162 of elastic member 160 is angled with respect to the vertical centerline CL of the clamping bracket 140. The top end 168 and upper portion 167 of elastic member 160 occupies part of the cavity occupied by the support member 110 when the clamping bracket 140 is fully mounted on the support member. In one, the top end 168 may be closer to the lateral midpoint of the cavity 148 than the first or second vertical sections 143, 145.

Next, the clamping bracket 140 is positioned above and over a support member 110, which has already been mounted and suspended from the ceiling or other overhead structure by the hangers 101. Cavity 148 is vertically aligned with the support member.

The clamping bracket 140 is then lowered and placed onto support member 110 which initially is received and partially inserted vertically upwards into the open cavity 148 of the clamping bracket. This action causes the top edge 116 of the support member vertical side 111 closest to clamping bracket vertical section 143 to engage, rotate, and displace elastic member 160 laterally towards vertical section 143 (to the left shown in FIG. 6). In one embodiment, top edge 116 of the support member may initially engage the intermediate portion 166 of elastic member 160, and then slide upwards along bend 164 and eventually upper portion 162 being engaged with bearing surface 167. Concurrently, in one mounting process, mounting tab 142 of the clamping bracket 140 may slide vertically along the opposing vertical side 115 of the support member 110 as the support member is inserted into cavity 148 of the clamping bracket.

Eventually, the top edges 116, 117 of support member 110 approach and engage the underside of clamping bracket top section 144 as shown in FIG. 6. Mounting tab 142 engages and snaps into tab opening 113 in vertical side 115 of support member 110. With the clamping bracket 140 now fully mounted on support member 110, elastic member 160 assumes the deflected active position (represented by 160' in dashed lines). Top end 168 of elastic member 160 is now located at a distance D2 from vertical section 143 of clamping bracket 140 (represented by 168') which is less than original distance D1 in the undeflected inactive position of the elastic member. It should be noted that distance D2 further generally defines a gap between vertical section 143 and vertical side 111 (except for thickness T2 of the elastic member 160).

Due to the elastic spring force of the elastic member, bearing surface 167 on upper portion 162 engages vertical side 111 of support member 110 and applies a lateral force F via bearing surface 167 against the support member acting in a horizontal direction towards vertical section 145 to help secure and retain the clamping bracket in position. The lateral force F essentially compresses the support member 110 (e.g. vertical side 115) against vertical section 145 on the distal side of the clamping bracket and helps to retain mounting tab 142 in tab opening 113. The support member 110 is asymmetrically positioned in the cavity 148 when the clamping bracket 140 is fully mounted as shown in FIG. 6. In the deflected active position, upper portion 162 of elastic member 160 is in a substantially vertical position or orientation (see 160' in FIG. 6) engaged with support member 110 as opposed to an angled position or orientation with respect to the vertical centerline CL of the clamping bracket 140 (see 160 in FIG. 6).

It should be noted that the elastic member 160 provide lateral or horizontal securement of the clamping bracket 140 to the support member 110 with the elastic member providing laterally stability to the mount. The mounting tab 142 of the clamping bracket 140 engages the support member 110 via tab opening 113 to help resist twisting of the bracket about the longitudinal axis LA of the support member that may be caused by the asymmetrical loading arrangement of the clamping bracket with cantilevered extension section 146 on one side projecting laterally outwards to which a ceiling element 130 may be attached. This arrangement creates a moment about the support member 110 (acting counterclockwise in FIG. 6) and the mounting tab 142 helps to prevent the vertical section 145 from slipping off of the support member. In other possible configurations where elastic member 160 is constructed to apply a sufficiently strong lateral force F against the support member 110 that adequately resists the twisting moment, the mounting tab 142 may be omitted from the clamping bracket 140.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure.

One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

The invention claimed is:

1. A ceiling system comprising:

a longitudinally-extending support member mountable from a ceiling, the support member comprising spaced apart opposing vertical sides arranged in parallel relationship;

a clamping bracket attachable to the support member, the clamping bracket including a first vertical section and a second opposing vertical section, the first and second vertical sections being spaced apart in parallel relationship to define a cavity configured to receive the support member at least partially therein;

a resiliently deformable elastic member connected to the clamping bracket and defining a movable bearing surface positioned in the cavity of the clamping bracket, the elastic member being movable from an undeflected inactive position to a deflected active position when the support member is inserted into the cavity of the clamping bracket;

wherein the bearing surface of the elastic member engages one of the vertical sides of the support member when the support member is inserted into the cavity and compresses the support member against the clamping bracket when the elastic member is in the deflected active position for securing the clamping bracket to the support member;

wherein the second vertical section of the clamping bracket includes a mounting tab which engages a mounting hole formed in one of the vertical sides of the support member.

2. The ceiling system of claim 1, wherein the bearing surface of the elastic member applies a lateral force against the support member when the elastic member is in the deflected active position.

3. The ceiling system of claim 1, wherein the elastic member has a smaller thickness than the clamping bracket.

4. The ceiling system of claim 1, wherein the elastic member is formed of a different material than the clamping bracket.

5. The ceiling system of claim 1, wherein the clamping bracket is more rigid in construction than the elastic member.

6. The ceiling system of claim 1, wherein the elastic member is connected to the first vertical section of the clamping bracket.

7. The ceiling system of claim 1, wherein the mounting tab is angled inwards towards the cavity of the clamping bracket.

8. The ceiling system of claim 1, wherein the clamping bracket includes a cantilevered lateral extension configured for mounting a ceiling element therefrom.

9. The ceiling system of claim 1, wherein the cavity of the clamping bracket is downwardly open, the support member being insertable upwards into the cavity.

10. The ceiling system of claim 1, wherein the elastic member includes a fixed bottom end connected to the first vertical section of the clamping bracket and a movable free top end adjacent the bearing surface, the top end being laterally displaced towards the first vertical section of the clamping bracket by inserting the support member into the cavity of the clamping bracket.

11. The ceiling system of claim 1, wherein a gap is formed between the bearing surface of the elastic member and the first vertical section of the clamping bracket when the elastic member is in the deflected active position.

12. The ceiling system of claim 1, wherein the bearing surface of the elastic member is in a vertical position when in the elastic member is in the deflected active position and an angled position when the elastic member is in the undeflected inactive position.

13. The ceiling system of claim 1, wherein the support member is U-shaped and a portion of the clamping bracket has an inverted U-shape.

14. The ceiling system of claim 1, wherein the bearing surface of the elastic member is engaged with the first vertical side and the second vertical section of the clamping bracket being engaged with the remaining second vertical side when the elastic member is in the deflected active position.

15. The ceiling system of claim 14, wherein the elastic member is connected to the first vertical section of the clamping bracket.

16. A method for mounting a ceiling element to a support member of a ceiling system, the method comprising:

providing a support member mountable from a ceiling, the support member including a first side and an opposing second side arranged in spaced apart parallel relationship;

vertically aligning an open cavity of a clamping bracket over the support member, the clamping bracket including a first section and an opposing second section arranged in parallel relationship;

lowering the clamping bracket onto the support member;

inserting the support member into the cavity;

engaging an angled tab on the first vertical section of the clamping bracket with a mounting hole formed in a first side of the support member;

laterally displacing a resiliently deformable elastic member disposed on the clamping bracket and positioned in the cavity with the support member; and applying a lateral force with a bearing surface of the elastic member against the support member when the support member is inserted into the cavity of the clamping bracket for securing the clamping bracket to the support member.

17. The method of claim 16, further comprising the lateral force compressing the support member against a first vertical section of the clamping bracket opposite the elastic member.

18. A clamping bracket attachable to a support member having spaced apart parallel sides for supporting a ceiling element of a ceiling system, the clamping bracket comprising:

a body configured for attachment to the support member, the body including a first vertical section and a second opposing vertical section, the first and second vertical sections being spaced apart to define a cavity configured to receive the support member at least partially therein; and a resiliently deformable elastic member connected to the first vertical section of the body, the elastic member having a movable bearing surface positioned in the cavity of the clamping bracket, the elastic member being movable from an undeflected inactive position to a deflected active position when the support member is inserted into the cavity;

wherein the bearing surface of the elastic member engages one of the vertical sides of the support member when the support member is inserted into the cavity and the elastic member is in the deflected active position;

wherein the second vertical section of the clamping bracket includes a mounting tab which engages a mounting hole formed in one of the sides of the support member.

* * * * *